US009885128B2

(12) United States Patent
Cliver et al.

(10) Patent No.: US 9,885,128 B2
(45) Date of Patent: Feb. 6, 2018

(54) ENERGY-ABSORBING TEXTILE MATERIAL

(75) Inventors: James D. Cliver, Roebuck, SC (US); J. Travis Greer, Chesnee, SC (US); Shulong Li, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 542 days.

(21) Appl. No.: 13/107,854

(22) Filed: May 13, 2011

(65) Prior Publication Data

US 2012/0286177 A1 Nov. 15, 2012

(51) Int. Cl.

| | |
|---|---|
| ***G21F 3/02*** | (2006.01) |
| ***D02G 3/44*** | (2006.01) |
| ***D03D 15/12*** | (2006.01) |
| ***A41D 31/00*** | (2006.01) |
| ***D06P 3/82*** | (2006.01) |
| ***D06M 11/74*** | (2006.01) |
| ***D06M 23/08*** | (2006.01) |
| ***D06P 1/44*** | (2006.01) |
| ***D06P 3/24*** | (2006.01) |
| ***D06P 3/26*** | (2006.01) |
| ***A62B 17/00*** | (2006.01) |
| *D06M 101/36* | (2006.01) |

(52) U.S. Cl.

CPC ..... *D02G 3/443* (2013.01); *A41D 31/0022* (2013.01); *A62B 17/003* (2013.01); *D03D 15/12* (2013.01); *D06M 11/74* (2013.01); *D06M 23/08* (2013.01); *D06P 1/44* (2013.01); *D06P 3/243* (2013.01); *D06P 3/26* (2013.01); *D06P 3/8209* (2013.01); *D06M 2101/36* (2013.01); *D06M 2200/25* (2013.01); *D06M 2200/30* (2013.01); *D10B 2331/021* (2013.01); *D10B 2501/04* (2013.01); *Y10T 442/3179* (2015.04)

(58) Field of Classification Search

CPC ..... D02G 3/443

USPC ..... 250/505.1, 515.1, 516.1, 519.1; 66/171

See application file for complete search history.

(56) References Cited

U.S. PATENT DOCUMENTS

| | | | | |
|---|---|---|---|---|
| 4,994,317 | A * | 2/1991 | Dugan et al. | 442/72 |
| 5,202,086 | A * | 4/1993 | Baliga et al. | 428/219 |
| 5,223,334 | A * | 6/1993 | Green | 442/214 |
| 6,451,070 | B1 * | 9/2002 | Kent et al. | 8/442 |
| 7,156,883 | B2 | 1/2007 | Lovasic et al. | |
| 7,348,059 | B2 | 3/2008 | Zhu et al. | |
| 7,811,952 | B2 | 10/2010 | Truesdale, III et al. | |
| 2004/0172774 | A1 * | 9/2004 | Birkinshaw et al. | 8/519 |
| 2006/0252325 | A1 * | 11/2006 | Matsumura et al. | 442/123 |
| 2008/0038973 | A1 | 2/2008 | Sasser et al. | |
| 2009/0181599 | A1 * | 7/2009 | Farmer et al. | 450/39 |
| 2009/0282596 | A1 * | 11/2009 | Carbajal et al. | 2/2.5 |
| 2009/0286436 | A1 * | 11/2009 | Koide et al. | 442/59 |
| 2010/0071115 | A1 * | 3/2010 | Sadato | 2/243.1 |
| 2010/0299516 | A1 * | 11/2010 | Hwang et al. | 713/150 |
| 2010/0299816 | A1 * | 12/2010 | Zhu | 2/458 |
| 2010/0299817 | A1 | 12/2010 | Zhu | |
| 2011/0004983 | A1 * | 1/2011 | Yagura et al. | 2/458 |
| 2011/0041232 | A1 * | 2/2011 | Covelli et al. | 2/69 |
| 2011/0191949 | A1 * | 8/2011 | Underwood | D02G 3/047 2/458 |
| 2011/0283435 | A1 * | 11/2011 | Smith et al. | 2/69 |

FOREIGN PATENT DOCUMENTS

| | | |
|---|---|---|
| WO | WO 97/28770 | 8/1997 |
| WO | WO 2007/014291 A2 | 2/2007 |
| WO | WO 2007/109100 A2 | 9/2007 |

OTHER PUBLICATIONS

International Search Report for PCT/US2012/036488 filed May 4, 2012, 5 pages.

Written Opinion of the International Searching Authority, dated May 4, 2012, 7 pages.

* cited by examiner

*Primary Examiner* — Jason McCormack

(74) *Attorney, Agent, or Firm* — Robert M. Lanning

(57) ABSTRACT

A textile material exhibiting enhanced energy absorption (e.g., enhanced near-infrared energy absorption) and, optionally, flame resistance. The textile material comprises a textile substrate and a finish disposed on at least one surface of the textile substrate. The finish comprises a binder and an energy-absorbing agent. A method for protecting an individual from infrared radiation that can be generated during an arc flash comprises the step of positioning a textile material between an individual and an apparatus capable of producing an arc flash.

25 Claims, No Drawings

ENERGY-ABSORBING TEXTILE MATERIAL

TECHNICAL FIELD OF THE INVENTION

This patent application relates to treated textile materials that provide protection from near-infrared radiation, such as that emitted by arc flashes.

BACKGROUND

An arc flash (or arc blast) is a type of electrical discharge resulting from a low impedance connection to ground or another voltage phase in an electrical system. In particular, the arc flash is produced by an electrical breakdown of the resistance of air which occurs when there is sufficient voltage in an electrical system and a path to ground or lower voltage. An arc flash typically releases a massive amount of energy that vaporizes metal conductors in the electrical system, blasting molten metal and expanding plasma outward from the source, and produces a shock wave due to the rapid heating of the gases in the vicinity. The arc flash and the metal plasma produced by the flash rapidly release tremendous amounts of electromagnetic radiation (e.g., light energy ranging from infrared to ultraviolet wavelengths), and this electromagnetic radiation rapidly heats the surfaces that it contacts. For example, the infrared radiation generated during an arc flash can cause severe burns to the unprotected or underprotected skin of individuals in the vicinity of the arc flash.

In view of the dangers posed by arc flashes, protective clothing systems called arc flash suits have been developed to protect workers at risk of exposure to arc flashes, such as electrical workers and electricians. Such suits are designed to provide varying degrees of protection to the wearer, with the requisite or recommended level of protection being determined by the severity of the arc flash that might be encountered while performing work. In order to provide the desired level(s) of protection, these arc flash suits are typically made from relatively heavy fabrics, the prevailing theory and principle of operation being that heavy fabrics block the electromagnetic radiation and provide insulation from the radiant heating caused by the arc flash. However, suits made from such heavy fabrics often become uncomfortable when worn for prolonged periods of time owing, at least in part, to the low air permeability of the heavy fabrics.

Accordingly, there is a need for lighter weight textile materials that protect from the radiation (e.g., near-infrared radiation) generated by an arc flash and are suitable for use in making garments that are comfortable to wear.

BRIEF SUMMARY OF THE INVENTION

In a first embodiment, the invention provides a textile material exhibiting enhanced energy absorption (e.g., enhanced infrared or near-infrared energy absorption) and, optionally, flame resistance. This enhanced energy absorption is believed to make the textile material suitable for use in protecting individuals from the infrared radiation generated by an electric arc flash. In this embodiment, the textile material comprises a textile substrate and a finish disposed on at least one surface of the textile substrate. The textile substrate comprises a plurality of first yarns disposed in a first direction in the textile substrate and a plurality of second yarns disposed in a second direction perpendicular to the first direction. The first yarns and the second yarns can be provided in a woven pattern selected from the group consisting of basket weaves, sateen weaves, satin weaves, rip-stop weaves, and twill weaves. The textile substrate can comprise about 30% or more by weight inherent flame resistant fibers. The finish disposed on the surface of the textile substrate comprises a binder and at least one energy-absorbing agent. The energy-absorbing agent can be selected from the group consisting of pigments, vat dyes, and combinations thereof. The energy-absorbing agent exhibits an absorbance of electromagnetic radiation at a wavelength of 1,000 nm ($A_{1000}$), an absorbance of electromagnetic radiation at a wavelength of 800 nm ($A_{800}$), and an absorbance of electromagnetic radiation within the range of wavelengths from 400 nm to 700 nm. The absorbance of electromagnetic radiation within the range of wavelengths from 400 nm to 700 nm also has a maximum ($A_{vis\ max}$). The result of dividing the absorbance at 800 nm by the maximum absorbance within the range of 400 nm to 700 nm (i.e., $A_{800}/A_{vis\ max}$) can be about 0.3 or more, and the result of dividing the absorbance at 1,000 nm by the maximum absorbance within the range of 400 nm to 700 nm (i.e., $A_{1000}/A_{vis\ max}$) can be about 0.1 or more.

In a second embodiment, the invention provides a method for protecting an individual from infrared radiation (e.g., near-infrared radiation) that can be generated during an arc flash. The method comprises the step of positioning a textile material between an individual and an apparatus capable of producing an arc flash. The textile material used in the method can be the same as that described above for the first embodiment of the invention described in this application. In this method embodiment of the invention, the textile material can be part of a garment worn by the individual.

DETAILED DESCRIPTION OF THE INVENTION

"Arc Thermal Protective Value" (ATPV) is a term used to refer to the minimum incident energy (expressed in calories per square centimeter) to which a piece of protective equipment (e.g., a protective garment or combination of protective garments) must be exposed in order to produce a fifty percent (50%) probability of causing the onset of a second-degree burn to skin underlying the protective equipment. The ATPV of a material (e.g., a textile material) can be determined in accordance with ASTM Standard Test Method F1959/F1959M-06a$^{\epsilon 1}$ entitled "Standard Test Method for Determining the Arc Rating of Materials for Clothing." Preferably, the textile material of the invention exhibits an ATPV of about 4 calories/cm$^2$ or more. More preferably, the textile material of the invention exhibits an ATPV of about 8 calories/cm$^2$ or more.

As noted above, the invention provides textile materials that may be flame resistant. As utilized herein, the term "flame resistant" refers to a material that burns slowly or is self-extinguishing after removal of an external source of ignition. The flame resistance of textile materials can be measured by any suitable test method, such as those described in National Fire Protection Association (NFPA) 701 entitled "Standard Methods of Fire Tests for Flame Propagation of Textiles and Films," ASTM Standard Test Method D6413 entitled "Standard Test Method for Flame Resistance of Textiles (vertical test)", NFPA 2112 entitled "Standard on Flame Resistant Garments for Protection of Industrial Personnel Against Flash Fire", ASTM F1506-10a entitled "The Standard Performance Specification for Flame Resistant Textile Materials for Wearing Apparel for Use by Electrical Workers Exposed to Momentary Electric Arc and Related Thermal Hazards", and ASTM Standard Test Method F1930-11 entitled "Standard Test Method for Evaluation of Flame Resistant Clothing for Protection Against Flash Fire Simulations Using an Instrumented Manikin." It is anticipated that the textile materials of the invention meet the minimum flame resistance requirements of ASTM F1506-10a including a maximum char length of 152 mm (6.0 inches) and a maximum of 2 seconds afterflame when tested according to ASTM Standard Test Method D6413.

The textile materials of the invention generally comprise a textile substrate (e.g., a fabric) formed from a plurality of yarns. The textile substrate can be formed from a single plurality or type of yarn (e.g., the fabric can be formed solely from yarns comprising a blend of meta-aramid fibers and one or more other synthetic fiber types, such as para-armaid fibers alone or in combination with other synthetic fibers), or the textile substrate can be formed from two or more pluralities or different types of yarns (e.g., the fabric can be formed from a first plurality of yarns a blend of meta-aramid fibers and one or more other synthetic fiber types and a second plurality of yarns comprising another fiber type or another blend of fibers). Preferably, the textile substrate is formed from a single type of yarn, such as a yarn comprising a blend of a meta-aramid fibers and at least one other synthetic fiber.

The textile substrate can be of any suitable construction. In other words, the yarns forming the textile substrate can be provided in any suitable patternwise arrangement producing the substrate (e.g., fabric). Preferably, the plurality of yarns forming the textile substrate comprise a plurality of first yarns disposed in a first direction in the textile substrate and a plurality of second yarns disposed in a second direction perpendicular to the first direction. Thus, the yarns forming the textile substrate preferably are provided in a woven pattern. More preferably, the yarns forming the textile substrate are provided in a woven pattern selected from the group consisting of basket weaves, sateen weaves, satin weaves, rip-stop weaves, and twill weaves. These woven patterns, most of which contain yarns that repeatedly float over two or more of the yarns running the perpendicular direction, produce a textile substrate having a greater thickness than a similar substrate formed from a plain weave. While not wishing to be bound to any particular theory, it is believed that this increased thickness may contribute, at least in part, to the enhanced protection from arc flashes (e.g., the near-infrared radiation produced by arc flashes) exhibited by the textile materials of the invention. In a preferred embodiment, the yarns forming the textile substrate are provided in a woven pattern selected from the group consisting of a 4×1 sateen weave, a 3×1 twill weave, and a 2×1 twill weave. Most preferably, the yarns forming the textile substrate are provided in a 4×1 sateen weave.

The yarns forming the textile substrate can be any suitable type of yarn. For example, at least some of the yarns, such as the warp yarns of a woven textile substrate, can be spun yarns. Preferably, the first yarns and the second yarns forming the textile substrate are both spun yarns. The spun yarns can be made from a single type of staple fiber (e.g., spun yarns formed solely from inherent flame resistant fibers), or the spun yarns can be made from a blend of two or more different types of staple fibers (e.g., spun yarns formed from a blend of inherent flame resistant fibers and at least one other synthetic fiber). Such spun yarns can be formed by any suitable spinning process, such as ring spinning, air-jet spinning, or open-end spinning. Preferably, the yarns are spun using either an open-end spinning process or an air-jet spinning process. In such embodiments, both pluralities of yarns (i.e., the plurality of first yarns and the plurality of second yarns) can be spun using the same process, or each plurality of yarns can be spun using a different process. For example, one plurality of yarns can be spun using an open-end spinning process, and the other plurality of yarns can be spun using an air-jet spinning process.

The yarns forming the textile substrate can comprise any suitable fiber or any suitable blend of fibers. As noted above, the first yarns and the second yarns can be the same or different (i.e., the yarns can comprise the same fiber or blend of fibers or the yarns can comprise different fibers or blends of fibers). Preferably, at least one plurality of yarns (e.g., the plurality of first yarns, the plurality of second yarns, or both) comprises inherent flame resistant fibers. As utilized herein, the term "inherent flame resistant fibers" is used to refer to synthetic fibers which, due to the chemical composition of the material from which they are made, exhibit flame resistance without the need for an additional flame retardant treatment. The inherent flame resistant fibers can be any suitable inherent flame resistant fibers, such as polyoxadiazole fibers, polysulfonamide fibers, poly(benzimidazole) fibers, poly(phenylenesulfide) fibers, aramid fibers (e.g., meta-aramid fibers and/or para-aramid fibers), polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. When present in the yarns, the inherent flame resistant fibers preferably are selected from the group consisting of polyoxadiazole fibers, polysulfonamide fibers, poly(benzimidazole) fibers, poly(phenylenesulfide) fibers, aramid fibers (e.g., meta-aramid fibers and/or para-aramid fibers), and combinations, mixtures, or blends thereof. More preferably, the inherent flame resistant fibers are aramid fibers, such as meta-aramid fibers or a blend of meta-aramid fibers and para-aramid fibers.

When present in a yarn forming the textile substrate, the inherent flame resistant fibers can comprise any suitable amount of the fibers present in the yarn. Preferably, at least one plurality of yarns (e.g., the plurality of first yarns, the plurality of second yarns, or both) comprises about 30% or more by weight inherent flame resistant fibers, based on the total weight of the fibers present in the yarn. More preferably, at least one plurality of yarns comprises about 35% or more, about 40% or more, about 45% or more, about 50% or more, about 55% or more, about 60% or more, about 65% or more, about 70% or more, about 75% or more, about 80% or more, about 85% or more, about 90% or more, or about 95% or more by weight inherent flame resistant fibers, based on the total weight of the fibers present in the yarn. In a preferred embodiment of the textile material of the invention, the plurality of first yarns and the plurality of second yarns forming the textile substrate each comprise about 50% or more (e.g., more preferably about 60% or more, more preferably about 70% or more, more preferably about 80% or more, more preferably about 90% or more, and most preferably about 95% or more) by weight inherent flame resistant fibers, based on the total weight of the fibers present in each yarn. If inherent flame resistant fibers are present in both pluralities of yarns, the amount of inherent flame resistant fibers contained in each plurality of yarns can be substantially the same or different. Preferably, when inherent flame resistant fibers are present in each plurality of yarns, the yarns contain substantially the same amount of inherent flame resistant fibers.

The yarn(s) forming the textile substrate can comprise other synthetic fibers, such as thermoplastic synthetic fibers. It will be understood that, if present, such synthetic fibers can be present in only one of the pluralities of yarns forming the textile substrate (e.g., the plurality of first yarns or the plurality of second yarns), or the synthetic fibers can be present in both pluralities of yarns forming the textile substrate (i.e., both the plurality of first yarns and the plurality of second yarns). Furthermore, if each plurality of yarns contains another synthetic fiber, the type and amount of synthetic fiber contained in each plurality of yarns can be substantially the same or different. Preferably, when such synthetic fibers are present in the yarns, each plurality of yarns contains the same type and substantially the same amount of such synthetic fibers. Suitable thermoplastic synthetic fibers include, but are not necessarily limited to, polyester fibers (e.g., poly(ethylene terephthalate) fibers, poly(propylene terephthalate) fibers, poly(trimethylene terephthalate) fibers), poly(butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, and combinations, mixtures, or blends thereof. The yarn(s) can include other synthetic fibers, such as static dissipative or antistatic fibers. Suitable static dissipative fibers include, but are not limited to, carbon fibers and fibers made from thermoplastic resin containing a sufficient amount of an electrically conductive additive to render the fiber static dissipative. In such thermoplastic static dissipative fibers, the electrically conductive additive can be, for example, carbon black, carbon nanotubes, graphite, copper particles, silver particles, and combinations thereof. Preferably, the static dissipative fibers are carbon fibers.

In a preferred embodiment, the yarns forming the textile substrate comprise a blend of aramid fibers and static dissipative fibers. In particular, the yarns comprise about 50% to about 95% (e.g., more preferably about 90% to about 95%) meta-aramid fibers, about 1% to about 10% (e.g., more preferably about 3% to about 7%) para-aramid fibers, and about 0.5% to about 4% (e.g., more preferably about 1% to about 3%) static dissipative fibers, based on the total weight of the blend. More preferably, the yarns comprise about 90% to about 95% meta-aramid fibers, about 3% to about 7% para-aramid fibers, and about 1% to about 3% static dissipative fibers, based on the total weight of the blend. In such embodiments, the yarns can comprise other fibers or fiber blends in addition to this blend, or the yarns can be composed solely of a blend described in this paragraph. Preferably, at least one plurality of yarns (e.g., the plurality of first yarns, the plurality of second yarns, or both) is composed solely of a fiber blend described in this paragraph. More preferably, both pluralities of yarns (i.e., both the plurality of first yarns and the plurality of second yarns) are composed solely of a fiber blend described in this paragraph.

The yarns forming the textile substrate can comprise fibers other than the inherent flame resistant fibers and synthetic fibers (e.g., thermoplastic synthetic fibers and static dissipative fibers) described above. For example, the yarns can comprise natural fibers, such as cotton, linen, jute, hemp, or wool. The yarns can also comprise other fibers, such as rayon, lyocell, or acetate. As with the other fibers, such fibers can be present in only one of the pluralities of yarns (e.g., the plurality of first yarns or the plurality of second yarns), or the fibers can be present in both pluralities of yarns (i.e., both the plurality of first yarns and the plurality of second yarns). When such fibers (e.g., cotton fibers) are present in the textile material of the invention, it may be desirable to treat the textile substrate or textile material with a flame retardant in order to impart some degree of flame resistance to these fibers and produce a textile material exhibiting a desired degree of flame resistance. The flame retardant used to treat such a textile substrate can be any suitable flame retardant used in the treatment of, for example, cellulosic fibers. Suitable treatments include, but are not limited to, halogenated flame retardants (e.g., brominated or chlorinated flame retardants), phosphorous-based flame retardants, antimony-based flame retardants, nitrogen-containing flame retardants, and combinations, mixtures, or blends thereof. Such flame retardants and methods for treating textile substrates using the same are known to those skilled in the art and are described in, for example, U.S. Pat. No. 3,900,664 (Miller), U.S. Pat. No. 7,713,891 (Li et al.), and U.S. Patent Application Publication No. US 2010/0210162 A1 (Li et al.), each of which is hereby incorporated by reference.

In preceding sections of this application, the fiber contents of the yarns (or at least a portion of the yarns) used in the forming textile substrate have been described. In some embodiments, the textile material of the invention can also be described by specifying the overall fiber content of the textile substrate. For example, in a preferred embodiment, the textile substrate comprises about 30% or more by weight inherent flame resistant fibers, based on the total weight of the textile substrate. More preferably, the textile substrate comprises about 35% or more, about 40% or more, about 45% or more, about 50% or more, about 55% or more, about 60% or more, about 65% or more, about 70% or more, about 75% or more, about 80% or more, about 85% or more, about 90% or more, or about 95% or more by weight inherent flame resistant fibers, based on the total weight of the textile substrate. In a preferred embodiment of the textile material of the invention, the textile substrate comprises about 50% or more (e.g., more preferably about 60% or more, more preferably about 70% or more, more preferably about 80% or more, more preferably about 90% or more, and most preferably about 95% or more) by weight inherent flame resistant fibers, based on the total weight of the textile substrate. In such embodiments, the inherent flame resistant fibers can be any suitable inherent flame resistant fibers, such as those described in preceding sections of this application.

In a particularly preferred embodiment of the textile material of the invention, the textile substrate comprises about 30% or more, about 35% or more, about 40% or more, about 45% or more, about 50% or more, about 55% or more, about 60% or more, about 65% or more, about 70% or more, about 75% or more, about 80% or more, about 85% or more, about 90% or more, or about 95% or more by weight aramid fibers, based on the total weight of the textile substrate. In another particularly preferred embodiment of the textile material of the invention, the textile substrate comprises about 50% or more (e.g., more preferably about 60% or more, more preferably about 70% or more, more preferably about 80% or more, more preferably about 90% or more, and most preferably about 95% or more) by weight aramid fibers, based on the total weight of the textile substrate. The aramid fibers present in such embodiments of the textile material can all be the same type of aramid fiber (e.g., all meta-aramid fibers), or the aramid fibers can be a blend of two or more different types of aramid fibers (e.g., a blend of meta-aramid fibers and para-aramid fibers). In a preferred embodiment of the textile material, the textile substrate comprises about 50% to about 95% (e.g., more preferably about 90% to about 95%) meta-aramid fibers and about 1% to about 10% (e.g., more preferably about 3% to about 7%) para-aramid fibers, based on the total weight of the textile substrate. In such an embodiment, the textile substrate can comprise other fibers, such as about 0.5% to about 4% (e.g., more preferably about 1% to about 3%) static dissipative fibers, based on the total weight of the textile substrate.

The textile substrate and the textile material of the invention can have any suitable weight (i.e., weight per unit area). As is noted below, the finish is applied to the textile substrate in a relatively small amount and, therefore, the weight of the untreated textile substrate and the weight of the textile material of the invention (to which the finish has been applied) will be substantially the same, at least for those embodiments in which the treated textile material of the invention does not contain additional layers of textile materials. Thus, for the sake of brevity, only the weight of the textile substrate will be discussed below. But it should be understood that the weight values listed below can also be used to specify the weight of the textile substrate to which the finish has been applied (i.e., a treated textile material according to the invention). The textile substrate preferably has a weight of about 16 oz/yd$^2$ or less (about 540 g/m$^2$ or less), about 14 oz/yd$^2$ or less (about 470 g/m$^2$ or less), about 12 oz/yd$^2$ or less (about 410 g/m$^2$ or less), about 10 oz/yd$^2$ or less (about 340 g/m$^2$ or less), about 9 oz/yd$^2$ or less (about 310 g/m$^2$ or less). More preferably, the textile substrate has a weight of about 8 oz/yd$^2$ or less (about 270 g/m$^2$ or less), more preferably about 7 oz/yd$^2$ or less (about 240 g/m$^2$ or less), more preferably about 6.5 oz/yd$^2$ or less (about 220 g/m$^2$ or less), more preferably about 6 oz/yd$^2$ or less (about 200 g/m$^2$ or less), and most preferably about 5.5 oz/yd$^2$ or less (about 190 g/m$^2$ or less). As was noted above, fabrics previously used in arc flash protection have generally been relatively heavy (i.e., they have had a relatively high weight per unit area). Therefore, the fact that the textile materials of the invention are capable of delivering the desired levels of arc flash protection at relatively light weights, such as weights of about 7 oz/yd$^2$ or less (about 240 g/m$^2$ or less), is surprising. Furthermore, these relatively light weight textile materials should be much more comfortable to wear for prolonged periods of time.

The textile material of the invention can be constructed to have any suitable thickness. In certain possibly preferred embodiments, the textile material has a thickness of at least about 19.5 mils (approx. 0.5 mm) as received. "As received", in this application, means the fabric at the end of all processing conditions (including weaving, desizing/scouring, dyeing, finish application, mechanical treatment, etc.) and is the fabric in the finished roll or sewn goods. The flame resistant textile material can also have a thickness of at least about 25 mils (approx. 0.64 mm) after 3 standard home laundering cycles using water at 120° F. (49° C.). While not wishing to be bound to any theory, it is believed that these thicker textile materials are able to provide greater protection from infrared radiation (e.g., near-infrared radiation).

The thickness of the textile material of the invention can depend upon several factors, such as the construction of the textile substrate and the mechanical treatments to which the textile substrate has been subjected. Thus, in certain embodiments, it may be desirable to subject the textile substrate to one or more mechanical treatments in order to increase the thickness of the textile substrate, which may improve the level of protection from infrared radiation (e.g., near-infrared radiation) afforded by the textile material. Suitable mechanical treatments include, but are not limited to, hydraulic napping treatments such as those described in, for example, U.S. Pat. No. 5,080,952 (Willbanks) and U.S. Pat. No. 6,546,605 (Emery et al.), each of which is hereby incorporated by reference.

As noted above, the treated textile material of the invention comprises a finish applied to at least one surface of the textile substrate. The finish comprises a binder and an energy-absorbing agent. The binder present in the finish can be any suitable binder that is durable to laundering, such as any of the binders typically used in the treatment of textile materials. Suitable binders include, but are not limited to, acrylic binders, polyurethane binders, vinyl polymer binders, vinyl copolymer binders, ethylene-vinylacetate copolymer binders, styrene butadiene rubber binders, nitrile rubber binders, natural rubber binders, neoprene rubber binders, epoxy binders, amino-resin binders, and combinations thereof.

The term "energy-absorbing agent" is used herein to describe a material that absorbs electromagnetic radiation in near-infrared wavelengths (e.g., 700 nm to 2,000 nm or 700 nm to 1,400 nm). The energy-absorbing agent can absorb electromagnetic radiation in other portions of the electromagnetic spectrum (e.g., visible wavelengths). However, in order to provide protection against harm caused by infrared radiation generated by an arc flash, the energy-absorbing agent should exhibit an appreciable absorption of near-infrared radiation. This property of the energy-absorbing agent used in the textile material of the invention distinguishes it from a large portion of the energy-absorbing materials typically used to treat textile materials. In particular, a large portion of the energy-absorbing materials used to treat textiles (e.g., dyes and pigments) are designed or selected to exhibit an appreciable absorption of visible radiation, which imparts a perceptible color to the treated textile material. Because the absorption of infrared radiation has no effect on the visually-perceived color of the textile material, these typical energy-absorbing materials generally exhibit very little absorption of infrared radiation. Indeed, the absorbance of such materials at wavelengths of 800 nm can be less than ten percent of the maximum absorbance exhibited by the material in the visible wavelengths, with the absorbance at longer wavelengths (e.g., 1,000 nm) being even less. With such low absorption of infrared radiation, these materials are not well-suited for use in absorbing infrared radiation because large amounts of the material must be used in order to achieve any appreciable absorption. Given the strong absorption that the materials exhibit in the visible wavelength, these large amounts will result in very darkly colored textile materials that also lack the tactile qualities (e.g., hand) that is desired for textile materials that are intended to be worn.

Thus, in order to provide the desired level of protection from infrared radiation without deleteriously affecting the properties of the textile material, the energy-absorbing agent used in the textile material of the invention preferably exhibits the absorption characteristics described below. An energy-absorbing agent exhibiting these characteristics will exhibit a sufficiently strong absorption of near-infrared radiation that it can be used in a relatively small amount and yet still deliver the desired degree of near-infrared absorption. The energy-absorbing agent is characterized as exhibiting an absorbance of electromagnetic radiation at a wavelength of 1,000 nm ($A_{1000}$) and an absorbance of electromagnetic radiation at a wavelength of 800 nm ($A_{800}$). The energy-absorbing agent also exhibits an absorbance of electromagnetic radiation within the range of wavelengths from 400 nm to 700 nm, and a maximum of the absorbance of electromagnetic radiation within the range of wavelengths from 400 nm to 700 nm ($A_{vis\ max}$). To be clear, $A_{vis\ max}$ is not necessarily the maximum absorbance exhibited by the energy-absorbing agent over the entire electromagnetic spectrum. Rather, $A_{vis\ max}$ refers to the point of maximum absorbance within the range of wavelengths from 400 nm to 700 nm, which corresponds to the visible portion of the electromagnetic spectrum. Preferably, the result of $A_{800}/A_{vis\ max}$ (i.e., the result of dividing the absorbance at 800 nm by the maximum absorbance within the range of wavelengths from 400 nm to 700 nm) is about 0.3 or more. The result of $A_{800}/A_{vis\ max}$ is more preferably about 0.4 or more and most preferably about 0.5 or more. The result of $A_{1000}/A_{vis\ max}$ (i.e., the result of dividing the absorbance at 1,000 nm by the maximum absorbance within the range of wavelengths from 400 nm to 700 nm) preferably is about 0.1 or more and more preferably about 0.2 or more (e.g., about 0.3 or more). The energy-absorbing agent can exhibit either the $A_{800}/A_{vis\ max}$ ratio recited above or the $A_{1000}/A_{vis\ max}$ ratio recited above. Preferably, the energy-absorbing agent exhibits both the $A_{800}/A_{vis\ max}$ ratio and the $A_{1000}/A_{vis\ max}$ ratio recited above.

The absorbance of the energy-absorbing agent (e.g., the $A_{800}$, $A_{1000}$, and the $A_{vis\ max}$) can be determined by any suitable method or analytical technique. However, as will be understood by those skilled in the art, the absorbance values of the energy-absorbing agent used in calculating the above-described ratios should be determined under the same conditions in order to permit an accurate comparison of the absorbance at the specified wavelengths and avoid any influence on the absorbance measurements that might result from different conditions (e.g., a different solvent). Typically, the absorbance values exhibited by the energy-absorbing agent are measured using a spectrometer or spectrophotometer. For example, when the energy-absorbing agent is a particulate material (e.g., a pigment), the particulate material can be dispersed in an aqueous media and the resulting dispersion used to measure the absorbance values of the energy-absorbing agent using a spectrometer.

The energy-absorbing agent can be any material that exhibits the electromagnetic radiation characteristics described above. Preferably, the energy-absorbing agent is selected from the group consisting of vat dyes, pigments, and combinations thereof that exhibit the electromagnetic radiation absorption characteristics described above. In a preferred embodiment, the energy-absorbing agent comprises a vat dye selected from the group consisting of dibenzanthrone derivatives, isobenzanthrone derivatives, and pyrazolanthrone derivatives that exhibit the electromagnetic radiation absorption characteristics described above. Furthermore, when the energy-absorbing agent is a vat dye selected from the classes listed above, it has been found that the presence of one or more amine groups can be beneficial to the performance of the textile material. Therefore, when the energy-absorbing agent is a vat dye, the vat dye preferably comprises at least two secondary amine groups. As noted above, the energy-absorbing agent can be a pigment that exhibits the electromagnetic radiation absorption characteristics described above. Suitable pigments for such an embodiment of the invention include, but are not limited to, carbon black.

The energy-absorbing material can be applied to the textile substrate in any suitable amount. In order to impart sufficient infrared absorption to the textile material, the energy-absorbing agent preferably is present in an amount of about 0.2% by weight or more, based on the weight of the textile substrate (i.e., the weight of the original textile substrate prior to application of the finish containing the binder and energy-absorbing agent). Furthermore, to avoid deleteriously affecting the tactile qualities of the textile material and over-coloring the textile material, the energy-absorbing agent preferably is present in an amount of about 5% by weight or less, more preferably about 4% by weight or less, more preferably about 3% by weight or less, more preferably about 2% by weight or less, and most preferably about 1% by weight or less, based on the weight of the textile substrate.

The textile material of the invention can be produced by any suitable process. For example, the textile material of the invention can be produced by first providing a textile substrate having the characteristics described above and applying to the textile substrate a finishing composition comprising a binder and an energy-absorbing agent such as those described above. The finishing composition can be applied to the textile substrate by any suitable technique, such as spraying, foam application, or padding. The finishing composition is applied to the textile substrate in an amount sufficient to yield the desired add-on level of the energy-absorbing agent in the finished textile material (e.g., to produce the desired add-on level of the energy-absorbing agent after the solvent/carrier in the finishing composition has been removed by drying).

The textile material of the invention can be used to make protective equipment designed to protect individuals from the hazards associated with an arc flash. For example, the textile material of the invention can be used as a component in single-layer or multiple-layer garments designed to exhibit a desired ATPV and/or exhibit a desired degree of flame resistance. For example, the textile material of the invention can be used to produce blankets and garments, such as shirts, pants, coats, hoods, aprons, and gloves.

In addition to the textile material described above, the invention also provides a method for protecting an individual from infrared radiation (e.g., near-infrared radiation) that can be generated during an arc flash. The method comprises the step of positioning a textile material between an individual and an apparatus capable of producing an arc flash. The textile material used in the method is any embodiment of the textile material of the invention described above.

In this method embodiment of the invention, the textile material can be positioned at any suitable point between the individual and the apparatus. However, in order to ensure that the textile material is positioned to afford the greatest degree of protection to the individual, the textile material preferably forms part of a garment worn by the individual. Suitable garments include, but are not limited to, shirts, pants, coats, hoods, aprons, and gloves. In a preferred embodiment, the outward-facing textile portions of a garment worn by the individual (i.e., those portions of the garment facing towards the apparatus when the garment is being worn by the individual) consist essentially of (or even more preferably consist of) a textile material according to the invention.

The method described above can be used to protect an individual from an arc flash produced by any piece of electrical equipment. Preferably, the apparatus is capable of producing an arc flash having an incident energy of about 1.2 calories/cm$^2$ or more (about 5 J/cm$^2$ or more) at a position at which the individual is located. More preferably, the apparatus is capable of producing an arc flash having an incident energy of about 4 calories/cm$^2$ or more (about 17 J/cm$^2$ or more) at a position at which the individual is located. The apparatus preferably is capable of producing an arc flash having an incident energy of about 8 calories/cm$^2$ or more (about 33 J/cm$^2$ or more) at a position at which the individual is located. An arc flash having an incident energy such as those described above (especially an arc flash having an incident energy of about 4 calories/cm$^2$ or more or about 8 calories/cm$^2$ or more) is capable of inflicting significant injury (e.g., second degree burns) to the unprotected or underprotected skin of an individual exposed to the arc flash.

The following examples further illustrate the subject matter described above but, of course, should not be construed as in any way limiting the scope thereof.

EXAMPLE

This example demonstrates the making of and properties of a textile material according to the invention and compares those properties to similar textile materials that have not been produced in accordance with the invention.

Four fabrics were produced from spun yarns made using a staple fiber blend containing approximately 93% by weight meta-aramid fibers, approximately 5% by weight para-aramid fibers, and approximately 2% by weight static dissipative, carbon fibers. Samples 1A and 1B were plain weave fabrics having a weight of approximately 6.0 oz/yd$^2$ produced using identical warp and fill yarns. Samples 1C and 1C were 4×1 sateen weave fabrics having a weight of approximately 6.2 oz/yd$^2$ produced using 16/1 open end spun warp yarns and 30/2 Murata jet spun fill yarns.

After the fabric was woven, Samples 1A and 1B were jet dyed a royal blue color using conventional cationic dyes and dyeing conditions for treating aramid-containing fabrics. Similarly, Samples 1C and 1D were jet dyed a navy blue color using conventional cationic dyes and dyeing conditions for treating aramid-containing fabrics.

Two of the four fabrics (i.e., Samples 1B and 1D) were treated with a finish in accordance with the present invention. In particular, the fabrics were padded with a finishing composition containing an energy-absorbing agent (i.e., a carbon black dispersion) and a binder. The energy-absorbing agent exhibited an $A_{800}/A_{vis\ max}$ of approximately 0.57 and an $A_{1000}/A_{vis\ max}$ of approximately 0.45. The concentration of the energy-absorbing agent in the finishing composition was approximately 7.5% by weight. The finishing composition was foamed onto the fabric at a 10% wet pickup. Thus, after drying, the treated fabrics had a finish disposed on their surface containing approximately 0.75% by weight of the energy-absorbing agent, based on the total weight of the fabric prior to finishing. Despite the application of the finish containing the energy-absorbing agent, the treated samples (i.e., Samples 1B and 1D) retained colors that were nearly identical to the colors exhibited by the corresponding untreated samples (i.e., Samples 1A and 1C, respectively).

The four fabrics were then tested in accordance with ASTM Standard Test Method F1959/F1959M-06$^{\epsilon 1}$ to determine the ATPV exhibited by each fabric. The resulting values are reported in the table below along with certain other physical properties of the fabrics.

TABLE

ATPV and select physical properties of Samples 1A-1D.

| | Sample 1A | Sample 1B | Sample 1C | Sample 1D |
|---|---|---|---|---|
| Weave | plain | plain | 4 × 1 sateen | 4 × 1 sateen |
| Color | Royal | Royal | Navy | Navy |
| Weight | 5.88 oz/yd$^2$ (199 g/m$^2$) | 5.80 oz/yd$^2$ (197 g/m$^2$) | 6.30 oz/yd$^2$ (214 g/m$^2$) | 6.20 oz/yd$^2$ (210 g/m$^2$) |
| Thickness | 24.7 mils (0.627 mm) | 25.7 mils (0.653 mm) | 32.5 mils (0.826 mm) | 34.8 mils (0.884 mm) |
| Energy-absorbing agent | — | 0.75% | — | 0.75% |
| ATPV | 6.3 cal/cm$^2$ (26 J/cm$^2$) | 8.0 cal/cm$^2$ (33 J/cm$^2$) | 7.2 cal/cm$^2$ (30 J/cm$^2$) | 9.4 cal/cm$^2$ (39 J/cm$^2$) |

As can be seen from the results set forth in the Table, both of the untreated fabrics (i.e., Samples 1A and 1C) exhibited ATPVs of less than 8.0 calories/cm$^2$. The addition of a finish comprising an energy-absorbing agent according to the invention raised the ATPV of each fabric to at least 8.0 calories/cm$^2$ (see, e.g., the results for Samples 1B and 1D). A comparison of the ATPV results for Samples 1B and 1D to those for Samples 1A and 1C also demonstrate the substantial increase in ATPV that can be achieved by utilizing a fabric construction (e.g., a 4×1 sateen weave) having a greater thickness than a plain weave fabric of similar weight. Thus, these results demonstrate that the most favorable increase in ATPV can be achieved by using the finish described in the application in combination with a fabric construction that yields a greater thickness, such as a sateen weave.

In order to determine the effects, if any, on the ATPV resulting from laundering of the fabrics, a sample of each of the treated fabrics (i.e., Samples 1B and 1D) was subjected to one hundred industrial laundering cycles. Each laundered fabric sample was then tested to determine its electromagnetic radiation absorption characteristics, and those characteristics were compared to the absorption characteristics exhibited by the treated fabric prior to laundering. This comparison revealed that the repeated launderings did not significantly change the electromagnetic radiation absorption characteristics of the treated fabrics. This data suggests that the treated fabric's ATPV will not be significantly affected by such launderings and, therefore, the treated fabric (i.e., a treated textile material according to the invention) can be used in making protective equipment that must maintain its ATPV despite laundering of the equipment.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contra dicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A textile material comprising:

(a) a textile substrate having a first surface and a second surface opposite the first surface, the textile substrate comprising a plurality of yarns, the plurality of yarns comprising a plurality of first yarns disposed in a first direction in the textile substrate and a plurality of second yarns disposed in a second direction perpendicular to the first direction, the first yarns and the second yarns being provided in a woven pattern selected from the group consisting of basket weaves, sateen weaves, satin weaves, rip-stop weaves, and twill weaves, the textile substrate comprising about 30% or more by weight inherent flame resistant fibers; and (b) a finish disposed on at least one surface of the textile substrate, the finish comprising a binder and at least one energy-absorbing agent, the energy-absorbing agent being selected from the group consisting of pigments, vat dyes, and combinations thereof, wherein the energy-absorbing agent exhibits an absorbance of electromagnetic radiation at a wavelength of 1,000 nm ($A_{1000}$), an absorbance of electromagnetic radiation at a wavelength of 800 nm ($A_{800}$), an absorbance of electromagnetic radiation within the range of wavelengths from 400 nm to 700 nm, and a maximum of the absorbance of electromagnetic radiation within the range of wavelengths from 400 nm to 700 nm ($A_{vis\ max}$), wherein the result of $A_{800}/A_{vis\ max}$ is about 0.3 or more, and wherein the result of $A_{1000}/A_{vis\ max}$ is about 0.1 or more.

2. The textile material of claim 1, wherein the first yarns and the second yarns are spun yarns.

3. The textile material of claim 2, wherein the first yarns and the second yarns comprise meta-aramid fibers.

4. The textile material of claim 3, wherein the first yarns and the second yarns comprise meta-aramid fibers and at least one other synthetic fiber.

5. The textile material of claim 4, wherein the first yarns and the second yarns comprise meta-aramid fibers and para-aramid fibers.

6. The textile material of claim 1, wherein the first yarns and the second yarns are provided in a woven pattern selected from the group consisting of a 4×1 sateen weave, a 3×1 twill weave, and a 2×1 twill weave.

7. The textile material of claim 1, wherein the result of $A_{800}/A_{vis\ max}$ is about 0.5 or more, and the result of $A_{1000}/A_{vis\ max}$ is about 0.2 or more.

8. The textile material of claim 1, wherein the energy-absorbing agent comprises a vat dye selected from the group consisting of dibenzanthrone derivatives, isobenzanthrone derivatives, and pyrazolanthrone derivatives.

9. The textile material of claim 8, wherein the vat dye comprises at least two secondary amine groups.

10. The textile material of claim 1, wherein the energy-absorbing agent is present in an amount of about 0.2% by weight or more, based on the weight of the textile substrate.

11. The textile material of claim 1, wherein the binder is selected from the group consisting of acrylic binders, polyurethane binders, vinyl polymer binders, vinyl copolymer binders, ethylene-vinylacetate copolymer binders, styrene butadiene rubber binders, nitrile rubber binders, natural rubber binders, neoprene rubber binders, epoxy binders, amino-resin binders, and combinations thereof.

12. A method for protecting an individual from infrared radiation that can be generated during an arc flash, the method comprising the step of positioning a textile material between an individual and an apparatus capable of producing an arc flash, the textile material comprising:

(a) a textile substrate having a first surface and a second surface opposite the first surface, the textile substrate comprising a plurality of yarns, the plurality of yarns comprising a plurality of first yarns disposed in a first direction in the textile substrate and a plurality of second yarns disposed in a second direction perpendicular to the first direction, the first yarns and the second yarns being provided in a woven pattern selected from the group consisting of basket weaves, sateen weaves, satin weaves, rip-stop weaves, and twill weaves, the textile substrate comprising about 30% or more by weight inherent flame resistant fibers, and (b) a finish disposed on at least one surface of the textile substrate, the finish comprising a binder and at least one energy-absorbing agent, the energy-absorbing agent being selected from the group consisting of pigments, vat dyes, and combinations thereof, wherein the energy-absorbing agent exhibits an absorbance of electromagnetic radiation at a wavelength of 1,000 nm ($A_{1000}$), an absorbance of electromagnetic radiation at a wavelength of 800 nm ($A_{800}$), an absorbance of electromagnetic radiation within the range of wavelengths from 400 nm to 700 nm, and a maximum of the absorbance of electromagnetic radiation within the range of wavelengths from 400 nm to 700 nm ($A_{vis\ max}$), wherein the result of $A_{800}/A_{vis\ max}$ is about 0.3 or more, and wherein the result of $A_{1000}/A_{vis\ max}$ is about 0.1 or more.

13. The method of claim 12, wherein the textile material is part of a garment worn by the individual.

14. The method of claim 12, wherein the apparatus is capable of producing an arc flash having an incident energy of about 1.2 calories/$cm^2$ or more at a position at which the individual is located.

15. The method of claim 14, wherein the apparatus is capable of producing an arc flash having an incident energy of about 8 calories/$cm^2$ or more at a position at which the individual is located.

16. The method of claim 13, wherein the first yarns and the second yarns are spun yarns.

17. The method of claim 16, wherein the first yarns and the second yarns comprise meta-aramid fibers.

18. The method of claim 17, wherein the first yarns and the second yarns comprise meta-aramid fibers and at least one other synthetic fiber.

19. The method of claim 18, wherein the first yarns and the second yarns comprise meta-aramid fibers and para-aramid fibers.

20. The method of claim 12, wherein the first yarns and the second yarns are provided in a woven pattern selected from the group consisting of a 4×1 sateen weave, a 3×1 twill weave, and a 2×1 twill weave.

21. The method of claim 12, wherein the result of $A_{800}/A_{vis\ max}$ is about 0.5 or more, and the result of $A_{1000}/A_{vis\ max}$ is about 0.2 or more.

22. The method of claim 12, wherein the energy-absorbing agent comprises a vat dye selected from the group consisting of dibenzanthrone derivatives, isobenzanthrone derivatives, and pyrazolanthrone derivatives.

23. The method of claim 22, wherein the vat dye comprises at least two secondary amine groups.

24. The method of claim 12, wherein the energy-absorbing agent is present in an amount of about 0.2% by weight or more, based on the weight of the textile substrate.

25. The method of claim 12, wherein the binder is acrylic binders, polyurethane binders, vinyl polymer binders, vinyl copolymer binders, ethylene-vinylacetate copolymer binders, styrene butadiene rubber binders, nitrile rubber binders, natural rubber binders, neoprene rubber binders, epoxy binders, amino-resin binders, and combinations thereof.

* * * * *